US009782787B2

(12) United States Patent
Beijbom

(10) Patent No.: US 9,782,787 B2
(45) Date of Patent: Oct. 10, 2017

(54) SPRAY GUN WASHING DEVICE, METHOD FOR PLACING THE GUN AND A GUN HOLDER

(75) Inventor: Peter Beijbom, Lund (SE)

(73) Assignee: Hedson Technologies AB (SE)

( * ) Notice: Subject to any disclaimer, the term of this patent is extended or adjusted under 35 U.S.C. 154(b) by 1146 days.

(21) Appl. No.: 13/574,790

(22) PCT Filed: Feb. 18, 2011

(86) PCT No.: PCT/SE2011/050180

§ 371 (c)(1),
(2), (4) Date: Aug. 22, 2012

(87) PCT Pub. No.: WO2011/105953

PCT Pub. Date: Sep. 1, 2011

(65) Prior Publication Data

US 2013/0042895 A1 Feb. 21, 2013

(30) Foreign Application Priority Data

Feb. 24, 2010 (SE) ..... 1050172

(51) Int. Cl.
*B05B 15/02* (2006.01)
*B08B 3/02* (2006.01)

(52) U.S. Cl.
CPC ..... *B05B 15/0283* (2013.01); *B05B 15/02* (2013.01); *B05B 15/025* (2013.01);
(Continued)

(58) Field of Classification Search
None
See application file for complete search history.

(56) References Cited

U.S. PATENT DOCUMENTS 4,025,363 A 5/1977 De Santis
5,485,860 A 1/1996 Robb et al.
(Continued)

FOREIGN PATENT DOCUMENTS

CN 201192669 11/1999
EP 0 286 658 7/1991
(Continued)

*Primary Examiner* — Michael Barr
*Assistant Examiner* — Jason Riggleman
(74) *Attorney, Agent, or Firm* — Tarolli, Sundheim, Covell & Tummino LLP

(57) ABSTRACT

The invention relates to a method for providing a spray gun (1) in a washing space (2) in a spray gun washing device (3), said spray gun comprising a paint passage (7) with a paint inlet (8). The washing space (2) comprises at least one cleaning nozzle (4) and an attachment surface (10). The cleaning nozzle (4) communicates with a cleaning medium system (5). The attachment surface (10) in the washing space (2) is configured to receive a spray gun (1) with a spray gun holder (9) since the position of the spray gun in the washing space is variable depending on the position of a paint inlet (8) of the spray gun relative to the position of the cleaning nozzle (4) in the washing space. The invention also relates to a spray gun washing device (3) comprising said characterizing features for cleaning the spray gun (1) which during cleaning is provided in said spray gun holder (9).

29 Claims, 3 Drawing Sheets

(52) U.S. Cl.
CPC ..... *B05B 15/0258* (2013.01); *B08B 3/02* (2013.01); *Y10T 29/49998* (2015.01)

(56) References Cited

U.S. PATENT DOCUMENTS

| | | | | |
|---|---|---|---|---|
| 5,937,875 | A * | 8/1999 | Nygren | B05B 15/0258 134/166 C |
| 6,860,278 | B2 * | 3/2005 | Huang | B08B 3/02 134/166 C |
| 2009/0314730 | A1 * | 12/2009 | Mansikkamaa | A47K 10/08 211/113 |

FOREIGN PATENT DOCUMENTS

| | | |
|---|---|---|
| EP | 1327479 | 7/2003 |
| EP | 1 386 671 | 4/2004 |
| EP | 1386671 | 4/2004 |
| GB | 2 311 475 | 10/1997 |
| WO | 88 02667 | 4/1988 |

* cited by examiner

SPRAY GUN WASHING DEVICE, METHOD FOR PLACING THE GUN AND A GUN HOLDER

RELATED APPLICATION

This application corresponds to PCT/SE2011/050180, filed Feb. 18, 20011, which claims the benefit of Swedish Application No. 1050172-4, filed Feb. 24, 2010, the subject matter, of which are incorporated herein by reference in their entirety herein by reference.

TECHNICAL FIELD

The present invention relates to a method for placing a spray gun in a washing space in a spray gun washing device according to claim 1. The invention also relates to a spray gun washing device with a washing space according to claim 9, and a spray gun holder for placing the spray gun in a washing space in a spray gun washing device according to claim 20.

BACKGROUND OF THE INVENTION

During enamelling of e.g. cars, a hand-operated spray gun is normally used. When the spray gun is used for enamelling, spraying, the spray gun is mostly connected to equipment providing high-pressure air. A container with paint is also normally connected to the spray gun. During change of paint, the paint container is removed from the spray gun. Before the other paint in another paint container is connected to the spray gun, it is necessary to clean a paint passage provided in the spray gun in order to prevent the previous paint remaining in the paint passage from being mixed with the new paint. A mixture of the paints may result in that the desired colour can not be obtained.

In the European patent specification EP1386671B1 there is described a device for cleaning the paint passage of a spray gun. During cleaning of the paint passage, this prior art spray gun is located in a position preventing the cleaning liquid from flowing into the passage for high-pressure air in the spray gun through the air inlet thereof. In the European patent specification EP0286658B1 there is described a device for cleaning the paint passage of a spray gun. As in EP1386671B1, the spray gun of EP0286658B1 is located in a position such that cleaning liquid can not flow into the passage for high-pressure air in the spray gun. Such a position of the spray gun of EP1386671B1 and EP0286658B1 also prevents particles and other dirt from entering into the spray gun passage for high-pressure air. A common problem at these prior art devices is that they are provided for washing primarily of spray guns of one size. If the spray gun has such size that there is no room for it in the holder carrying the spray gun during cleaning, the position of the washing elements such as the cleaning nozzle must be adapted to fit the spray gun to be washed. If a spray gun has an inlet to the paint passage which is not standard, this may result in that the spray gun can not be washed in the spray gun washing devices of e.g. EP1386671B1 and EP0286658B1.

SUMMARY OF THE INVENTION

An object of the present invention is to provide a spray gun washing device making it possible to wash or clean the paint passage of a spray gun independent of the size of the spray gun.

Another object is to be able, with a minimum of procedural steps, to locate the spray gun in a position for cleaning the paint passage in a spray gun washing device.

A further object is to provide a spray gun washing device which can be produced in a cost effective manner.

A still further object is to provide a method for placing a spray gun in a spray gun washing device such that the time for washing the spray gun can be optimized.

The above and other objects are achieved according to the present invention by providing the invention defined above with the characterizing measures and features, respectively of claim 1 and 9.

An advantage achieved by means of the method according to claim 1 and by means of the device according to claim 9 is that the number of steps for fixing the spray gun in wash position in a spray gun washing device is optimized.

Another advantage achieved by means of the method according to claim 1 and by means of the device according to claim 9 is that the time for locating and fixing the spray gun in the washing space is optimized.

An additional advantage achieved by means of the method according to claim 1 and by means of the device according to claim 9 is that cleaning of a spray gun inside the washing space may be performed independent of type and size of the spray gun.

Preferred embodiments of the method according to the invention have been given the characterizing measures of claims 2-8.

Preferred embodiments of the device according to the invention have been given the characterizing features of claims 10-19.

A further object of the present invention is to provide a spray gun holder which is configured to carry a spray gun and for variable location in a washing space in a spray gun washing device.

The above and other objects are achieved according to the present invention by providing the invention defined above with the characterizing features of claim 20.

An advantage achieved by means of the device of claim 20 is that one and the same spray gun holder can be used independent of which size and shape a conventional spray gun has.

Preferred embodiments of the device according to the invention have been given the characterizing features of claims 21 and 22.

According to one embodiment of the method, the spray gun is placed in a washing space by carrying said spray gun in its position in the washing space by means of a holder which is provided outside of the paint inlet of the spray gun. Correspondingly, in an embodiment of the spray gun washing device, the spray gun holder carries the spray gun in the washing space by being located with the spray gun outside of the paint inlet of the spray gun. This means that the spray gun in its position in the washing space is not carried by an element located in the paint inlet. The spray gun holder carries the spray gun in the washing space by being provided against the spray gun and against the surface of the spray gun as well as parts thereof which are not found inside the paint inlet of the spray gun. A result of not carrying the spray gun in its position through the paint inlet is that said paint inlet can thereby also be cleaned by cleaning liquid from the cleaning nozzle in the washing space. If the spray gun was to be carried by an element through the paint inlet, this element must be removed for efficient cleaning of the paint inlet.

According to one embodiment of the method, the spray gun is carried in its position at the attachment surface by magnetism. A result thereof is that the position of the spray gun in the washing space can be varied.

According to one embodiment of the method, the spray gun is carried in its position at the attachment surface by means of a coupling element. The coupling element can be a mechanical coupling element. The coupling element may e.g. be a coupling element of Velcro-type. At an embodiment with said element of Velcro-type, the attachment surface can be provided with one part of said element and the spray gun holder with another part thereof. When the spray gun holder is placed against the attachment surface, the position of the spray gun holder and the spray gun in the washing space relative to the attachment surface is determined by the force and function of the Velcro-type coupling element.

According to one embodiment of the method, the spray gun and the spray gun holder are located as a unit against the attachment surface. For cleaning of the spray gun, the spray gun holder and the spray gun are brought together outside of the washing space. Then, they are moved towards the attachment surface and magnetically attached thereto. The result thereof is that all active components such as cleaning nozzle and attachment surface in the washing space may thereby be fixedly or statically located. This, in turn, results in that no adaptation of the components and their positions in the washing space is required when positioning the spray gun in said washing space. This is true irrespective of the type, size and shape of the spray gun. According to one embodiment of the method, a yoke element holds a trigger on the spray gun in such a position that the paint inlet of the spray gun is open for through-flow. A result thereof is that residues of paint and other products in the paint passage can be flushed away from said paint passage during through-flow thereof.

According to one embodiment of the method, a yoke element of the spray gun holder is carried as an integrated part of said spray gun holder. A result thereof is that the yoke element and the spray gun holder can be manufactured as a unit. Thereby, the cost for manufacturing the spray gun holder with yoke element is optimized.

According to one embodiment of the method, the spray gun holder and the spray gun are removed from the attachment surface as a unit after cleaning. Since the spray gun is mounted in the spray gun holder and the spray gun holder is the part which is magnetically connected to the attachment surface, the removal of the spray gun holder and the spray gun is carried through as a unit. After removal from the attachment surface, the spray gun is removed or released from the spray gun holder. The spray gun holder may then be located against the attachment surface such that it is easy to find the next time it shall be used or such that it is not mislaid by mistake.

According to one embodiment of the spray gun washing device, the attachment surface is provided inside the washing space at a distance from a wall portion. The attachment surface is, in a plan in parallel to said surface, configured to carry the spray gun holder provided between a wall portion of the washing space and the cleaning nozzle. A result thereof is that the attachment surface can thereby be a releasably connected unit in the washing space. It will thereby be possible to replace the attachment surface when said surface is e.g. worn out. The wearing may, inter alia, mean that the attachment surface after some time is covered with dry residues of paint such that the ability to attach something magnetically to the surface has deteriorated.

According to one embodiment, the attachment surface is provided inside the washing space as an integrated part of a wall portion. An integrated attachment surface in the wall portion results in that said attachment surface can consist of a surface which is configured to be directly provided, or attached to, said wall portion in the washing space. This attachment can be accomplished by connecting the attachment surface to said wall portion by means of an adhesive or coupling elements. Alternatively, the attachment surface can consist of a magnetic material which by magnetic power is provided against the rear wall portion. According to a further embodiment, the attachment surface can be connected to the rear wall portion by means of coupling elements of Velcro-type. Another alternative to the integration is that the attachment surface forms a part of the wall portion. A result of that the attachment surface can be integrated in a wall portion is that dirt and paint residues which during a washing cycle can adhere to the attachment surface thereby only adhere to one side of the attachment surface. This because the attachment surface is exposed with only one side inside the washing space.

According to one embodiment, the wall portion to which the attachment surface is configured to be connected to, in or against, a rear wall portion.

According to one embodiment, the wall portion of the washing space can consist of a wall portion represented by said rear wall portion and to which rear wall portion other wall portions referred to as screening elements are connected.

According to an additional embodiment, the washing space can consist of a wall portion which is circular in shape and to which a cylindrical wall portion is provided. This embodiment results in a washing space comprising a bottom element defined by the circular wall portion and with a wall portion which is cylindrical as well as an opening opposite to the bottom element. The opening into the space is in this embodiment provided in such a way that the spray gun holder, spray gun and possible associated components, for cleaning, are moved through the opening and into the space from above. An attachment surface is in this washing space with cylindrical wall portion provided inside the space, surrounded by said cylindrical wall portion.

According to one embodiment, the attachment surface against which the spray gun holder can be provided in the washing space, is vertically mounted. By means of the vertical position of the attachment surface, paint residues, dirt, particles and liquids found on the attachment surface during cleaning of the spray gun and its components, can flow off the attachment surface by gravity and then flow down into a collecting container.

According to one embodiment, the attachment surface is made of a material with magnetic properties. Thereby, the spray gun holder can be provided magnetically against the attachment surface in a position for cleaning of the spray gun inside the washing space. A further result thereof is that since the connection between the spray gun holder and attachment surface is magnetic, there is no need for attachment elements in the attachment surface. The attachment surface can thereby be kept free from protruding holding elements or from holes in the attachment surface, such that cleaning of said attachment surface after a washing cycle is facilitated.

According to one embodiment, the attachment surface is made of a material permitting provision on one side of a magnetic material which by a magnetic force through the attachment surface is configured to carry a spray gun holder and/or a spray gun against the opposite side of the attachment surface, whereby the attachment surface is thereby located between the magnetic element and the spray gun holder and/or spray gun. A result thereof is that the attachment surface can be made of a non-magnetic material, e.g. a plastic. A magnetic element can thereby be provided outside the washing space, e.g. against an outer side of a wall portion, e.g. the rear wall portion. A magnetic force through the attachment surface from or towards the magnetic element on one side of the attachment surface can thereby magnetically carry a spray gun holder on an opposite side of the attachment surface inside the washing space.

According to one embodiment, the spray gun holder comprises a yoke element which is configured to hold the spray gun with the trigger in a pulled position and which is e.g. resilient. The yoke element is in the illustrated embodiment configured to hold the spray gun with the trigger pulled. With pulled position means that the paint passage of the spray gun is open due to the pulled trigger. Thereby, during cleaning, the paint passage of the spray gun can be flushed by a cleaning liquid. The yoke element is resilient in the illustrated embodiment. Thereby, the spray gun can be connected to the spray gun holder by means of a clamping force between two opposing elements of the yoke element, fixing the spray gun in a fixed position relative to the spray gun holder.

According to one embodiment, the spray gun holder comprises a handle. The handle can be an integrated part of the spray gun holder. A result of that the spray gun holder comprises a handle is that it simplifies provision of the spray gun holder with spray gun against the attachment surface as well as the removal thereof from the attachment surface. This since a user thereby can hold the spray gun holder by its handle. A further effect of the handle is that if the spray gun is dirty before cleaning thereof, a user can avoid being dirty during e.g. provision or location of the spray gun against the attachment surface.

According to one embodiment, the spray gun holder comprises at least one magnetic attaching element. The attaching element may be an integrated part of the spray gun holder. A result of that the attaching element is magnetic is that it makes it possible to locate the spray gun holder magnetically against the attachment surface.

According to one embodiment, the spray gun holder is configured to be provided magnetically against the attachment surface in the washing space. The spray gun holder comprises, according to another embodiment, a handle. Thereby, the spray gun holder is in the illustrated embodiment configured to be located magnetically against the attachment surface. This also means that the spray gun holder comprises a handle as described above.

According to one embodiment, the invention also relates to a spray gun holder which is configured to be provided with a spray gun for carrying said spray gun in a washing space in a spray gun washing device, said spray gun holder comprising a yoke element, preferably resilient, configured to hold the spray gun with the trigger in a pulled position, said spray gun holder further being provided with an attaching element which is configured to cooperate with an attachment surface in the washing space. The spray gun holder is configured to be located together with the yoke element around the handle and trigger of the spray gun. In this position between spray gun and spray gun holder, the spray gun is provided statically with the spray gun holder.

BRIEF DESCRIPTION OF THE DRAWINGS

A preferred embodiment of the device according to the invention will be described below with reference to the accompanying schematic drawings, in which only the details necessary for understanding the invention are illustrated.

DETAILED DESCRIPTION OF PREFERRED EMBODIMENTS

Figure 1:
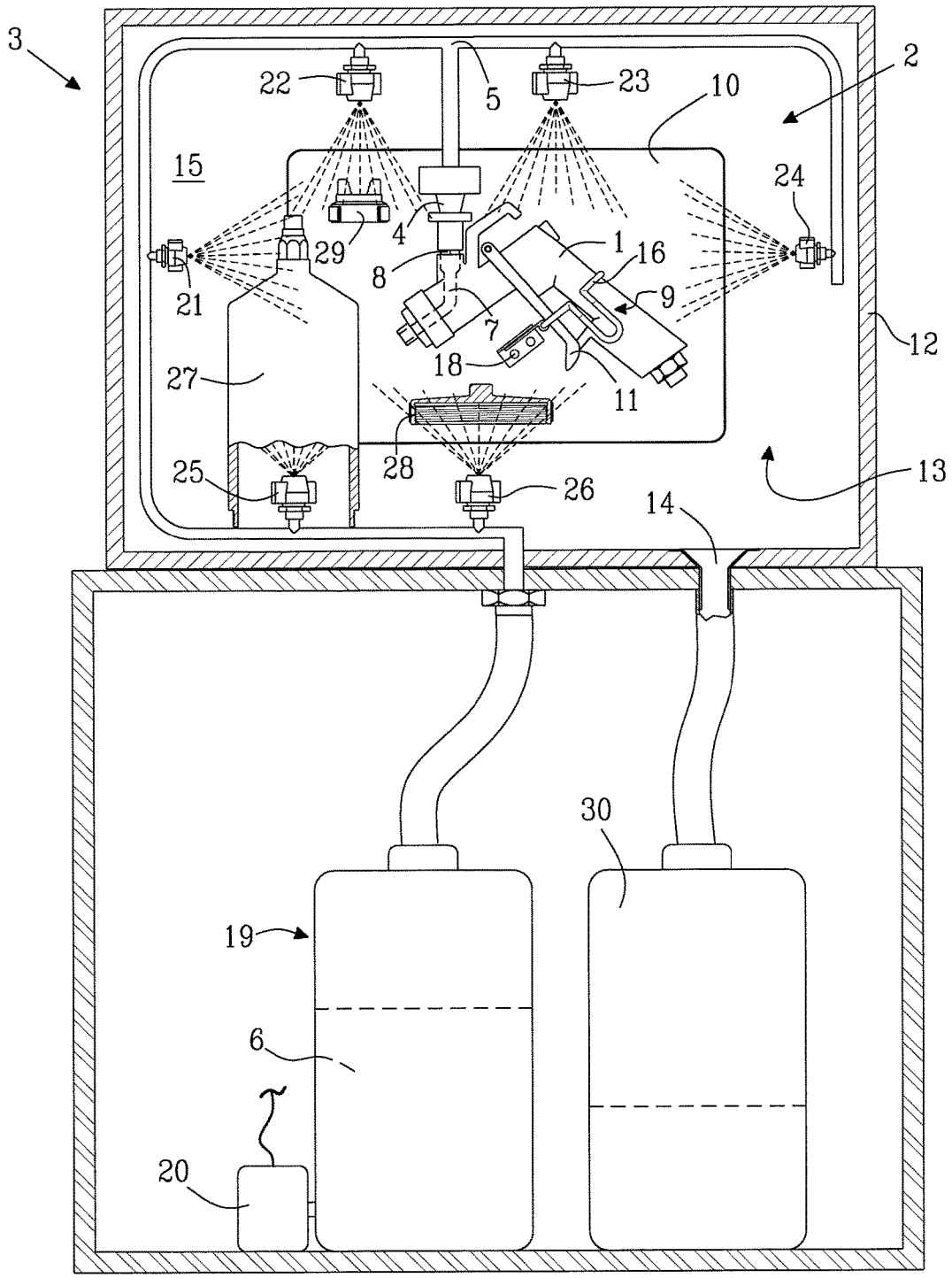
FIG. 1 is a sectional view of a spray gun washing device.

FIG. 1 illustrates a spray gun washing device 3 with a spray gun 1 located in a washing space 2 of the spray gun washing device. The spray gun 1, which is a conventional spray gun, comprises a paint passage 7 which is communicating with a paint inlet 8 of the spray gun. After use or change of paint, the paint passage 7 must be cleaned for, inter alia, preventing discoloration during painting with another paint in the spray gun 1. Cleaning of the paint passage 7 is achieved by providing the spray gun 1 in a wash position in the washing space 2. For being able to provide or locate the spray gun 1 in wash position in the washing space 2, the spray gun is located therein together with a spray gun holder 9. The spray gun holder 9 comprises a yoke element 16 which is configured to hold the spray gun 1, whereby the spray gun holder and spray gun 1 during a wash cycle of the spray gun and the paint passage 7 therein, in the washing space 2, can be compared to a unit. The spray gun 1 and the spray gun holder 9 are provided at an attachment surface 10 in the washing space 2. The spray gun 1 located in the yoke element 16 is provided with its paint passage 7 open, since a trigger 11 to the spray gun is pulled.

The spray gun 1 is oriented against the attachment surface 10 in the washing space 2 such that the paint inlet 8 of the spray gun is provided to adjoin a cleaning nozzle 4 inside the washing space. According to one embodiment, the cleaning nozzle 4 is during a wash cycle provided with a portion thereof inside the paint inlet 8. The cleaning nozzle 4 communicates with a cleaning medium system 5 in the spray gun cleaning device 3. Communication is achieved by connecting the cleaning nozzle 4 to the cleaning medium system 5. A source 19 of cleaning medium 6 is connected to the cleaning medium system 5. The cleaning medium 6 is brought through the cleaning medium system 5 to the cleaning nozzle 4 by means of a pump 20 which is connected to said cleaning medium system. The pump 20 is configured to be set in active or non-active position.

The washing space 2 is limited partly by a rear wall portion 15 and partly by a screening element 12. The screening element 12 can be compared to a splash guard. The screening element 12 is connected to the rear wall portion 15 and provided to extend substantially around an edge portion of said rear wall portion. Thereby, the rear wall portion 15 and the screening element 12 define together a space with an opening 13, or passage, into said space, which is the washing space 2. Washing of the spray gun 1 can thereby be performed during relatively sealed and shielded conditions inside the washing space 2, whereby splashes of paint and cleaning medium remain inside the washing space. According to one embodiment, an openable cover, not illustrated, can be provided for opening and closing the opening 13. The result thereof is that washing of the spray gun 1 can be performed in a completely sealed environment inside the washing space 2.

In a lower portion of the washing space 2 there is provided an outlet 14. This outlet 14 is configured to lead cleaning medium 6, particles of paint and other residues formed during washing and cleaning in the washing space 2, out through said outlet into a collecting container 30. The collecting container 30 can be provided and integrated in the spray gun washing device 3. According to one embodiment, the collecting container may be located outside of the spray gun washing device 3 (not illustrated in the drawings). According to another embodiment, the outlet can communicate, be connected, directly to a discharge system in the premises or the area where said spray gun washing device 3 is used (not illustrated in the drawings). The outlet 14 is configured to be opened and closed. Normally, the outlet 14 is open.

In the washing space 2, additional cleaning nozzles, defined as first alternative cleaning nozzle 21, second alternative cleaning nozzle 22, third alternative cleaning nozzle 23, fourth alternative cleaning nozzle 24, fifth alternative cleaning nozzle 25 and sixth alternative cleaning nozzle 26, can be provided. These alternative cleaning nozzles 21-26 are in a corresponding manner as said first cleaning nozzle 4 connected to the cleaning medium system 5.

In the embodiment of FIG. 1, the first and second alternative cleaning nozzles 21, 22 are provided on one side of the cleaning nozzle 4. On the other side of the cleaning nozzle 4, the third and fourth alternative cleaning nozzles 23, 24 are provided. In FIG. 1, the first to fourth alternative cleaning nozzle 21-24 are e.g. provided in an upper part of the washing space 2. Thereby, it is achieved that cleaning medium 6 can flow from said alternative cleaning nozzles 21-24 towards the spray gun 1, whereby the outer side of the spray gun is also cleaned. The fifth and sixth cleaning nozzle 25, 26 are e.g. provided in a lower part of the washing space 2. Thanks to the location of the alternative cleaning nozzles 21-26 in the washing space 2 at a distance around the cleaning nozzle 4, it is achieved that cleaning medium 6 can be sprayed in a plurality of directions towards a spray gun 1 in the washing space.

One or more fittings and/or suspension devices may be provided in the washing space 2 for carrying releasable components of the spray gun 1. Such components can be placed or attached to these fittings or suspension devices. During a wash cycle when cleaning a spray gun 1, said components can also be cleaned at the same time in the washing space 2. Releasable components are e.g. paint containers 27, paint container lids 28 and spray outlet nozzles 29. The spray gun 1 is prepared for cleaning by, inter alia, demounting said components and placing them in the washing space 2 (see FIG. 1). If the spray gun 1 in use is connected to an air hose feeding pressurized air from a pressurized-air unit to the spray gun, then said air hose must also be removed from the spray gun. The spray gun holder 9 comprises one or more attachment elements 18. This or these attaching elements 18 is/are defined by at least one magnet. Furthermore, the spray gun holder 9 comprises a handle 17. The handle 17 is configured to be held with one hand. This should be possible when the spray gun 1 is placed in the yoke element 16 as well as when the spray gun holder 9 with the spray gun is located in its washing position in the washing space 2. The washing position for the spray gun 1 is maintained by positioning the spray gun holder 9 with spray gun magnetically to an attachment surface 10 in the washing space 2. The attachment surface 10 is made of a magnetic material, e.g. a metal, and configured to cooperate by magnetism with the attachment element 18 on the spray gun holder 9. Alternatively, according to an embodiment not illustrated in the drawings, the spray gun holder 9 can cooperate directly with the attachment surface 10 by magnetism. The magnetic force between the spray gun holder 9 and the attachment surface 10 is so strong that said spray gun holder with the spray gun 1 do not move relative to the attachment surface during cleaning.

The position of the spray gun 1 against the attachment surface 10 in the washing space 2 is variable thanks to the position of the paint inlet 8 relative to the position of the cleaning nozzle 4 in the washing space 2. The attachment, connection, between the spray gun holder 9 and the attachment surface 10 can thereby be established freely over the attachment surface. The parameters determining where the attachment element 18 on the spray gun holder 9 shall be connected to the attachment surface 10, is partly the size of the spray gun 1 and partly the position of the paint inlet 8 of the spray gun relative to the cleaning nozzle 4. Depending on the size and type of the spray gun 1, the spray gun holder 9 can thereby be provided, fixed, with the spray gun 1 at different distances from the paint inlet 8 of the spray gun. Hereby, the size and type of the spray gun is not a limiting factor with regard to whether the spray gun can be located in the spray gun washing device according to the invention or not.

Figure 2:
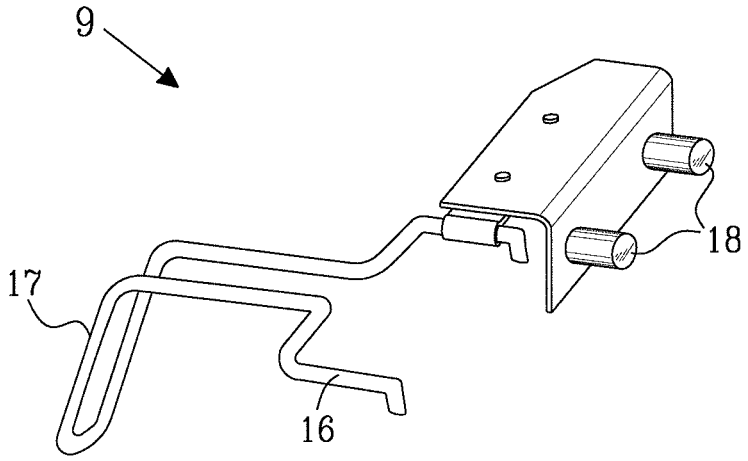
FIG. 2 is a view of a spray gun holder.

The members in the washing space 2, such as the attachment surface 10, cleaning nozzles 4, 21-26, are statically provided in said washing space. This because it is the position of the spray gun 1 that is variable and adaptable in the washing space 2 before a washing cycle is performed. According to one embodiment not illustrated in the drawings, an adapter element can be provided between the cleaning nozzle 4 and the paint inlet 8. This adapter element may be an adapter forming part of the paint inlet 8. Alternatively, the adapter element can be an extension element between the paint inlet 8 and the cleaning nozzle 4. FIG. 2 illustrates a spray gun holder 9. The spray gun holder 9 comprises a yoke element 16.

The yoke element 16 has the function of a clamp since the yoke element comprises two opposing members which are configured to spring towards each other. Thereby, a spray gun 1 can be positioned between said two opposing members of the yoke element 16 in a fixed clamped position. The spray gun holder 9 comprises a handle 17. The handle 17 is defined by an extension of the yoke element 16, said extension being an integrated part of said yoke element. The handle 17 and the yoke element 16 can be made of e.g. a steel element. Alternatively, a plastic material or a composite material or any other suitable material can be used. In the illustrated embodiment, the steel element consists of a steel wire which is bent to a shape as shown in FIG. 2. For connecting the spray gun holder 9 to an attachment surface 10, as described above in connection with FIG. 1, the spray gun holder comprises an attachment element 18. This attachment element 18 comprises at least one magnet. In the embodiment of FIG. 2, the attachment element 18 comprises two magnets. The magnets are configured to be provided magnetically against the attachment surface 10 of the spray gun washing device 3. Said attachment element 18 is connected to the yoke element 16, thereby defining said spray gun holder 9. According to one embodiment, the attachment element 18 is an integrated part of the yoke element.

Figure 3:
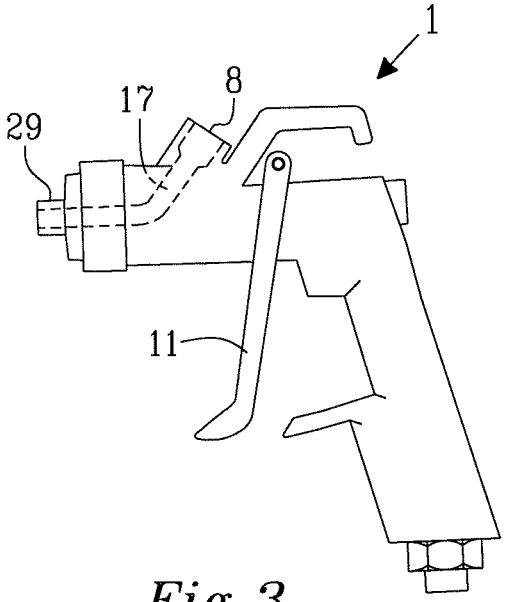
FIG. 3 is a view of a conventional spray gun with the trigger in an inactive position.

FIG. 3 illustrates a conventional spray gun 1 with a trigger 11 located in a non-active position. In this position, a paint passage 7 inside the spray gun 1 is closed.

Figure 4:
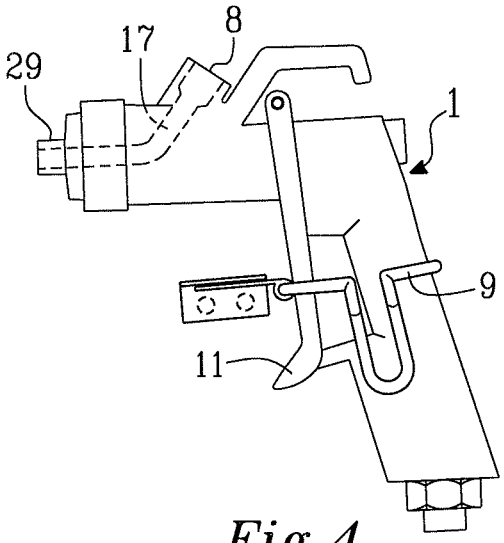
FIG. 4 is a view of a conventional spray gun provided in a spray gun holder according to FIG. 2 with the trigger in a depressed, active position.

FIG. 4 illustrates a spray gun 1 placed in a spray gun holder 9 as described above in connection with FIG. 2. The spray gun 1 is placed in the spray gun holder 9 in such a way that the trigger 11 is pulled. When the trigger 11 is pulled, the paint passage 7 is open. When the paint passage 7 is open, a cleaning medium flowing into the paint inlet 9 of the spray gun 1 can pass through the paint passage 7 of the spray gun and flow out through the spray gun outlet and its spray outlet nozzle 29.

In prior art, the trigger is held in pulled position by means of an external coupling element which is located against and around the handle of the spray gun. This external coupling element is then located above the spray gun handle and the trigger, whereby the paint passage in the spray gun is open. Then, the spray gun is placed in any type of fixture which holds the spray gun fixed during cleaning thereof. The spray gun holder 9 of FIG. 4 can hold the trigger 11 in pulled position as well as the spray gun 1 in fixed position during cleaning. Thereby, at least one moment during cleaning of the spray gun is reduced, such that the total time for cleaning can be optimized.

Figure 5:
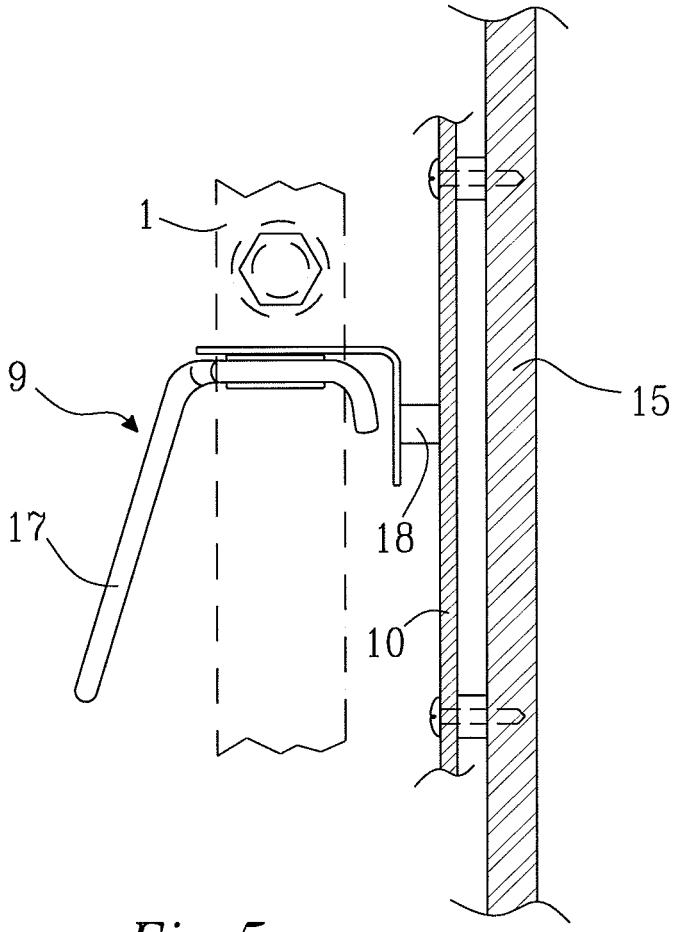
FIG. 5 is a sectional view of a part of a spray gun in a spray gun holder provided against an attachment surface.

FIG. 5 is a sectional view showing the spray gun 1 and spray gun holder 9 provided against the attachment surface 10 in the washing space 2. In the embodiment of FIG. 5, the attachment surface 10 is found lying against the rear wall portion 15 of the washing space 2. Thereby, the attachment surface 10 can be replaced e.g. after possible wearing. Another reason for being able to replace the attachment surface 10 may be if e.g. said surface after some time in use has been covered, or partly covered, with dry paint which is difficult to remove, whereby the magnetic force between the attachment surface and the spray gun holder 9 can be negatively affected. According to an embodiment not illustrated in the drawings, the attachment surface 10 can be integrated in the rear wall portion 15 or form part thereof. The attachment surface 10 according to FIG. 5 is positioned vertically. Thereby, paint and liquid reaching the attachment surface 10 can flow off said surface by gravity. Thus, the vertical position of the attachment surface 10 facilitates cleaning of said surface, since paint and liquid can flow off the attachment surface partly by itself.

According to one embodiment, the spray gun washing device 3 can be provided with a container (not illustrated) for heavy duty cleaning of the spray gun 1 and its components. The container then forms part of the spray gun washing device 3. The container is located with an outlet for discharge of liquid and paint residues into a collecting container 30. The outlet is configured for closing and opening thereof. The container can be positioned in the spray gun washing device 3 such that its upper edge portion is close to a lower portion of the washing space 2. Thereby, it is possible to initially perform an effective heavy duty cleaning of the spray gun 1 and its components and then locate the spray gun in the washing space 2 for cleaning the spray gun and its paint passage 7. Another result achieved by means of said container is that if the spray gun 1 is located in the washing space 2 for washing of said spray gun, simultaneous cleaning of other objects can be performed in said container without affecting the cleaning in the washing space. The invention is not limited to the illustrated embodiment, but can be varied and modified within the scope of the subsequent claims, as partly defined above.

REFERENCE NUMERALS

1. spray gun
2. washing space
3. spray gun washing device
4. cleaning nozzle
5. cleaning medium system
6. cleaning medium
7. paint passage
8. paint inlet
9. spray gun holder
10. attachment surface
11. trigger
12. screening element
13. opening
14. outlet
15. rear wall portion
16. yoke element
17. handle
18. attachment element
19. source
20. pump
21. first alternative cleaning nozzle
22. second alternative cleaning nozzle
23. third alternative cleaning nozzle
24. fourth alternative cleaning nozzle
25. fifth alternative cleaning nozzle
26. sixth alternative cleaning nozzle
27. paint container
28. paint container lid
29. spray outlet nozzle
30. collecting container

The invention claimed is:

1. Method for providing a spray gun (1) in a washing space (2) in a spray gun washing device (3), said spray gun comprising a paint passage (7) with a paint inlet (8), said washing space comprising at least one cleaning nozzle (4) which communicates with a cleaning medium system (5), wherein the method comprises the steps of:

configuring the paint passage (7) of the spray gun (1) to be open, and providing the spray gun holder (9) on an attachment surface (10) in the washing space (2), said attachment surface comprising a planar surface of a plate secured to the washing device and being configured to carry the spray gun holder (9) by magnetism such that the spray gun can be held in different positions depending on the position of the paint inlet (8) on the spray gun for aligning the paint inlet (8) with the cleaning nozzle (4) in the washing space.

2. Method for providing a spray gun (1) in a washing space (2) according to claim 1, wherein the spray gun (1) and the spray gun holder (9) are provided against the attachment surface (10) as a unit.

3. Method for providing a spray gun (1) in a washing space (2) according to claim 1, wherein a yoke element (16) holds a trigger (11) on the spray gun (1) in such a position that the paint passage (7) of the spray gun is open for flow through said paint passage.

4. Method for providing a spray gun (1) in a washing space (2) according to claim 1, wherein a yoke element (16) is carried by the spray gun holder (9) as an integrated part thereof.

5. Method for providing a spray gun (1) in a washing space (2) according to claim 1, wherein the spray gun holder (9) and the spray gun (1) are after cleaning thereof removed from the attachment surface (10) as a unit.

6. Method for providing a spray gun in a washing space according to claim 1, further including rigidly fixing the position of the spray gun on the attachment surface with a spray gun holder that extends around the exterior of the spray gun and supports the weight of the spray gun on the attachment surface.

7. Method for providing a spray gun in a washing space according to claim 6, further including maintaining a handle of the spray gun in a depressed condition with the spray gun holder.

8. Method for providing a spray gun in a washing space according to claim 6, further including connecting at least one magnet to the spray gun holder and engaging the attachment surface with the at least one magnet to rigidly fix the spray gun in position on the attachment surface.

9. Method for providing a spray gun (1) in a washing space (2) according to claim 1 further comprising rotating and translating the spray gun (1) within a plane extending parallel to the attachment surface (10) to place the spray gun (1) in the different positions.

10. Method for providing a spray gun (1) in a washing space (2) according to claim 1, wherein the spray gun holder (9) is positioned entirely on one side of the attachment surface when carrying the spray gun (1) in the washing space (2).

11. Method for providing a spray gun (1) in a washing space (2) according to claim 3, wherein the yoke element (16) is secured to the attachment surface (10) by magnetism to prevent any movement of the spray gun (1) in the washing space (2) during washing of the spray gun (1).

12. Method for providing a spray gun (1) in a washing space (2) according to claim 1, wherein the spray gun (1) is carried in position in the washing space (2) by a spray gun holder (9) secured to the exterior of the spray gun (1) while spaced entirely from the paint inlet (8) of the spray gun (1).

13. Spray gun washing device with a washing space (2) for cleaning a spray gun (1), preferably for cleaning a paint passage (7) in the spray gun, said washing space comprising at least one cleaning nozzle (4) which communicates with a cleaning medium system (5), an opening (13) and an outlet (14), wherein the washing space (2) comprises an attachment surface (10), said attachment surface comprising a planar surface of a plate secured to the washing device and being configured to permit provision in the washing space of a spray gun holder (9) carrying a spray gun (1) by magnetism such that the spray gun holder with the spray gun (1) can be held in different positions depending on the position of a paint inlet (8) on the spray gun for aligning the paint inlet (8) with the cleaning nozzle (4) in the washing space.

14. Spray gun washing device with a washing space (2) according to claim 13, wherein the spray gun holder (9) carries the spray gun (1) in its position in the washing space (2) to prevent any movement of the spray gun (1) in the washing space (2) during washing of the spray gun (1) by extending around the exterior of the spray gun while being spaced entirely from the paint inlet (8) of the spray gun.

15. Spray gun washing device with a washing space (2) according to claim 13, wherein the attachment surface (10) is provided in the washing space (2) at a distance from a rear wall portion (15) thereof.

16. Spray gun washing device with a washing space (2) according to claim 13, wherein the attachment surface (10) is provided in the washing space (2) as an integrated part of a rear wall portion (15) thereof.

17. Spray gun washing device with a washing space (2) according to claim 13, wherein the attachment surface (10) against which the spray gun holder (9) can be provided in the washing space (2) is vertically located.

18. Spray gun washing device with a washing space (2) according to claim 13, wherein the attachment surface (10) is made of a magnetic material with magnetic properties.

19. Spray gun washing device with a washing space (2) according to claim 13, wherein the attachment surface (10) is made of a material permitting provision on one side thereof of a magnetic element which by a magnetic force through the attachment surface is configured to carry a spray gun holder (9) against the opposite side of the attachment surface, such that the attachment surface is located between the magnetic element and the spray gun holder.

20. Spray gun washing device with a washing space (2) according to claim 13, wherein the spray gun holder (9) comprises a yoke element (16) which is configured to hold the spray gun (1) with the trigger in a pulled position.

21. Spray gun washing device with a washing space (2) according to claim 13, wherein the spray gun holder (9) comprises a handle (17).

22. Spray gun washing device with a washing space (2) according to claim 13, wherein the spray gun holder (9) comprises at least one magnetic attachment element (18).

23. Spray gun holder which is configured to be provided with a spray gun (1) for carrying said spray gun in a washing space (2) in a spray gun washing device (3) according to claim 13, wherein the spray gun holder (9) comprises a yoke element (16), which is configured to hold the spray gun (1) with the trigger (11) in a pulled position, said spray gun holder being provided with an attachment element (18) which is configured to be provided magnetically against an attachment surface (10) in the washing space (2).

24. Spray gun holder, which is configured to be provided with a spray gun (1), according to claim 23, wherein the spray gun holder (9) comprises a handle (17).

25. Spray gun washing device with a washing space according to claim 13, wherein the position of the spray gun is rigidly fixed on the attachment surface with a spray gun holder that extends around the exterior of the spray gun and supports the weight of the spray gun on the attachment surface.

26. Spray gun washing device with a washing space according to claim 13, wherein a handle of the spray gun is maintained in a depressed condition by the spray gun holder.

27. Spray gun washing device with a washing space according to claim 13, wherein at least one magnet connected to the spray gun holder engages the attachment surface to rigidly fix the spray gun in position on the attachment surface.

28. Spray gun washing device with a washing space (2) according to claim 13, wherein the spray gun (1) is rotatable and translatable within a plane extending parallel to the attachment surface (10) to place the spray gun (1) in the different positions.

29. Spray gun washing device with a washing space (2) according to claim 13, wherein the spray gun holder (9) is positioned entirely on one side of the attachment surface when carrying the spray gun (1) in the washing space (2).

* * * * *